US005620096A

United States Patent [19]

Pozzo

[11] Patent Number: 5,620,096

[45] Date of Patent: Apr. 15, 1997

[54] INFLATABLE PACKAGING CUSHION WITH POCKET

[75] Inventor: Michel Pozzo, Neuilly S/Seine, France

[73] Assignee: Sealed Air Corporation, Saddle Brook, N.J.

[21] Appl. No.: 651,860

[22] Filed: May 21, 1996

[51] Int. Cl.[6] ..... B65D 81/03

[52] U.S. Cl. ..... 206/450; 206/522

[58] Field of Search ..... 206/450, 454, 206/522, 591, 592, 594; 410/119

[56] References Cited

U.S. PATENT DOCUMENTS

| | | | |
|---|---|---|---|
| 3,398,501 | 8/1968 | Aninger | 206/522 X |
| 3,554,135 | 1/1971 | Duvall et al. . | |
| 3,889,743 | 6/1975 | Presnick . | |
| 3,949,879 | 4/1976 | Peterson et al. . | |
| 4,155,453 | 5/1979 | Ono . | |
| 4,465,188 | 8/1984 | Soroka et al. . | |
| 4,874,093 | 10/1989 | Pharo . | |
| 4,925,029 | 5/1990 | Friedman et al. . | |
| 5,184,727 | 2/1993 | Dickie et al. . | |
| 5,348,157 | 9/1994 | Pozzo . | |
| 5,351,829 | 10/1994 | Batsford . | |
| 5,447,235 | 9/1995 | Pharo . | |
| 5,454,642 | 10/1995 | DeLuca | 206/522 X |

*Primary Examiner*—Jacob K. Ackun

*Attorney, Agent, or Firm*—Bell, Seltzer, Park & Gibson, P.A.

[57] ABSTRACT

There is provided an inflatable cushion inflated through a single inflation valve and having a pocket. The inflatable packaging cushion is made of flexible thermoplastic material adapted to be at least partially charged with air and including a containment portion, an article-holding portion, a hinged portion interconnected to the padded portion and the padded portion. A pocket is formed integrally with the article-holding portion for holding an article. There are a plurality of internal openings in the hinged portion to facilitate the containment portion being folded over the article-holding portion.

The containment portion protecting the article folds across and covers a major portion of the top of the article which is in the pouch of the article-holding portion. The containment portion has an internal opening in the middle thereof formed by a seam. The opening prevents over-inflation of the containment portion and keeps that portion from becoming too bulky. In another embodiment, the article-holding portion has an internal opening.

10 Claims, 1 Drawing Sheet

INFLATABLE PACKAGING CUSHION WITH POCKET

BACKGROUND OF THE INVENTION

1. Field of the Invention

The present invention relates to an inflatable packaging cushion. More particularly, it relates to an inflatable packaging cushion which protects a thin article during shipping.

2. The Prior Art

Protective packaging material for articles of different sizes and shapes is commonly used to cushion articles during shipping. There are numerous types and forms of packaging material for this purpose including waste paper, embossed paper, air cellular bubble wrap materials and loose fill materials, known as peanuts. These forms of cushioning material, however, are not well suited for mailing single thin articles such as computer disks, hard drives and the like.

In seeking better protective packaging materials for articles of different size and shape including thin articles, various forms of air inflated cushions have been suggested. One example of such a cushion is described in U.S. Pat. No. 4,798,123 to Pharo which discloses an inflatable bag having a pouch for retaining an article and adapted to be rolled-up to assume a spiralled configuration for cushioning the article. The Pharo bag is inflated after the article is placed in the pouch, the air bag rolled around the package, and placed in a shipping container. Such cushions are unnecessarily bulky.

Another example of inflatable packaging is shown in U.S. Pat. No. 5,447,235 to Pharo which discloses an inflatable packaging which is formed of a pair of overlying inner panels defining a pocket and adapted to retain an article in the pocket and an inflating portion for communicating through the overlying inner panels. An outer panel overlays each of the inner panels to form an inflatable chamber therebetween. The overlying edge portions of the inner and outer panels are seamed together except at one edge to expose the pocket. The inflatable chambers are maintained in a sealed position upon inflation by inflation pressure from the inflatable chambers acting upon the inflation portion.

In U.S. Pat. No. 4,155,453 to Ono there is described an inflatable packaging system which forms a sleeve for holding articles. After inflation, the inflatable sleeve on the open end of the compartment may be folded to completely seal the compartment between the double walls and having a fastener, such as a zipper or a twist-clasp, to seal the sleeve.

U.S. Pat. No. 4,465,188 to Soroka, et al. discloses an inflatable packaging sleeve in which the article to be protected is simply shipped in a compartment formed between inflatable chambers. The Soroka, et al. packaging structure acts like an envelope and does not have a member folding over the top to provide protection.

The disadvantages of the prior art packaging discussed above are overcome by use of the inflatable packaging cushion of the present invention as hereafter described.

SUMMARY OF THE INVENTION

Therefore, it is an object of the present invention to provide an inflatable packaging cushion for protecting thin articles during shipping.

Another object of the present invention is to provide an inflatable packaging cushion having a pocket for retaining a thin article and a containment flap which easily folds over the top of the article.

A further object of the present invention is to provide an inflatable packaging cushion which is inflated through a single valve, is not bulky, and protects thin articles.

It has been found that the foregoing objects are accomplished in accordance with this invention by providing an inflatable cushion formed from a pair of thermoplastic sheets that have been juxtaposed one upon the other, heat sealed around their peripheral edge and cut to the desired shape and size. The inflatable packaging cushion is adapted to be at least partially charged with air through a single inflation valve and includes a padded containment portion, a padded article-holding portion, a hinged portion interconnected to the padded containment portion and the padded article-holding portion.

A pocket is formed integrally with the padded article-holding portion for holding an article. The pocket is formed from a third piece of thermoplastic material sealed around three sides to the first two pieces forming a pocket for retaining a thin article.

The padded containment portion of the cushion folds over the padded article-holding portion to completely protect the thin article on all sides. The hinge portion has at least one, and preferably a plurality of, internal openings to facilitate the padded containment portion being folded over the article-holding portion. Within the area of the hinge portion there are air passages beside the internal openings so that both padded portions may be filled through a single inflation valve.

The padded containment portion folds across and covers a major portion of the top of the thin article which is in the pouch of the article-holding portion. The padded containment portion has an internal opening in the middle thereof formed by a seam. The opening prevents over-inflation of the containment portion and keeps that portion from becoming too bulky. In another embodiment, the article-holding portion likewise has an internal opening.

BRIEF DESCRIPTION OF THE DRAWINGS

Other objects, features and advantages of the invention will become apparent from the following detailed description of the invention when taken in conjunction with the accompanying drawings, in which.

DETAILED DESCRIPTION OF THE PREFERRED EMBODIMENTS

Figure 1:
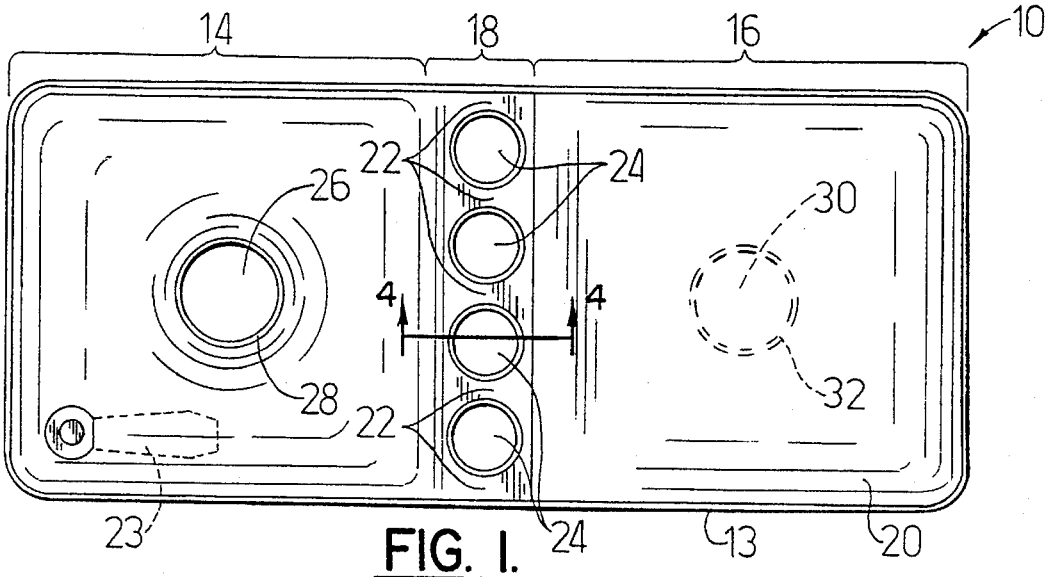
FIG. 1 is a plan view of the inflatable packaging cushion of FIG. 2 made in accordance with this invention in its deflated state.
Figure 2:
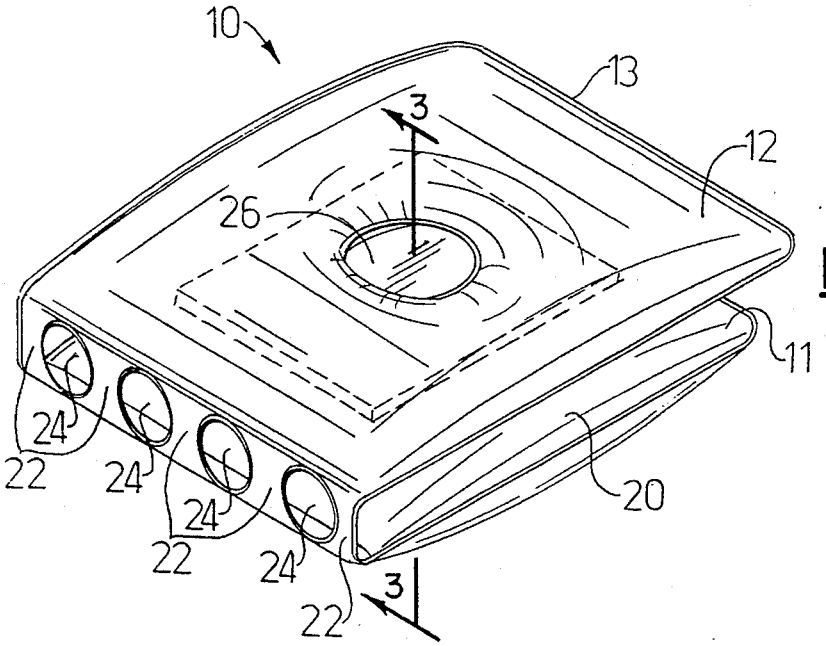
FIG. 2 is an isometric view illustrating an embodiment of the inflatable packaging cushion of the present invention in its inflated form surrounding an article to be protected.

Referring now to the drawings, and in particular FIGS. 1 and 2, there is shown an inflatable packaging cushion 10 made in accordance with this invention for protecting a thin article A. The cushion 10 is a single inflatable chamber having a first padded containment portion 14 and a second padded article-holding portion 16 of approximately the same size. The first and second padded portions are interconnected by hinge portion 18. A pocket or pouch for retaining thin article A is made integral with the second padded article-holding portion 16.

As shown in FIG. 2, the inflatable cushion 10 is made of two sheets 11, 12 of air impervious thermoplastic material. Any number of commercially available air impervious thermoplastic materials may be used. The sheets are juxtaposed over each other and sealed together in the region of their external peripheral edges—i.e., seam lines 13, to form a single chamber. The sealing may be formed by conventional techniques, for example, heat sealing. The thermoplastic sheets should be sufficiently flexible to adapt to the contours of the article to be packaged and, at the same time, sufficiently robust not to be pierced by parts of the article A to be protected. The cushions of these materials can be deflated and reused but can also be incinerated, without release of toxic vapor, or can be recycled.

The pocket is formed from a third piece of thermoplastic material 20, which is sealed around the three external edges of the second padded article-holding portion 14.

Figure 4:
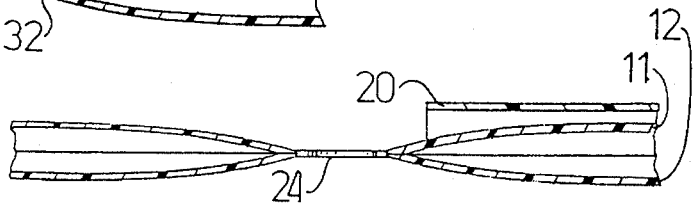
FIG. 4 is a partial side view of the inflatable cushion of the present invention taken along lines 4—4 of FIG. 1.

As shown in FIG. 2, hinged portion 18 has a plurality of internal openings 24 which make it easier for the first padded containment portion 14 to fold over the pocket containing second padded article-holding portion 16. The edges of the sheets are sealed around the internal openings 24. The areas between the internal openings 24 form narrow airways 22 (see FIG. 4) so that both padded portions 14, 16 may be filled through one single inflation valve 23.

Figure 3:
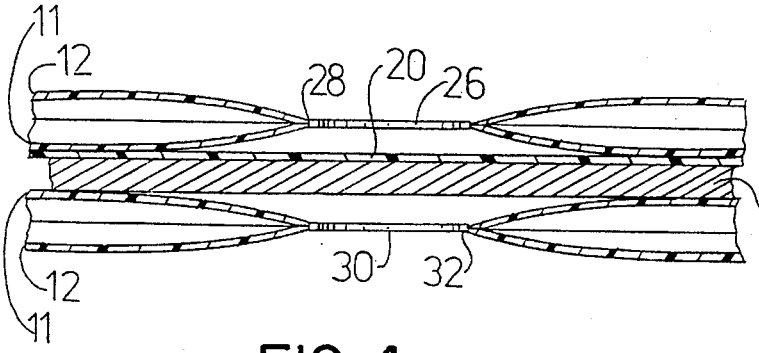
FIG. 3 is a partial side view of the inflatable cushion of the present invention taken along lines 3—3 of FIG. 2.

The inflatable padded containment portion 14 has an internal opening 26 in the middle thereof which is sealed at its internal edge 28, which serves to maintain the size and shape of the containment portion and prevent the middle sections of the containment portions from being too bulky upon inflation, as shown more clearly in FIG. 3. The size of internal opening 26 can be adjusted in order to control the desired inflated cushion thickness. In another embodiment, the padded article-holding portion 16 also contains an internal opening 30 in the middle thereof to prevent over-inflation (note FIG. 4). In addition, the internal edges 32 are sealed in the same manner also along seam lines 13 and the cushion cut to form the various internal openings.

The inflatable packaging cushion 10 includes a single valve 23 for inflation. As noted in FIG. 2, the inflatable chamber is inflated through inflation valve 23 which may be located at any one of a number of regions along the sides or top of the cushion. The inflation valve 23 is any one of the well-known types of self-sealing inflating valves which typically comprise two thin sheets of plastic juxtaposed and seamed together along lines so as to form a passage conduit for an inflating hose. The valve 23 is located between the two sheets 11, 12 forming the cushion. As a filler medium, preferably air, is passed into the inflation valve 23, the chambers and panels in the cushion 10 inflate to protect article A. Furthermore, it is not necessary to completely fill the cushion with air to provide the desired protection. Also articles may be placed inside the pouch prior to inflation or after inflation.

As shown in FIG. 2, an outline of article A illustrates how the article fits in the pocket formed in second padded article-holding portion 16. As the cushion 10 is inflated, first padded containment portion 14 starts to inflate and air passes from there through interconnecting airways 22, to inflate second padded portion 16. The ability of the first padded containment portion 16 to be folded over the second padded portion 14 to contain the thin article A is facilitated by internal openings 24. Preferably a plurality of openings is used.

In operation, the inflatable chamber is designed for an article of a specific size and is inflated and positioned around the article and then placed into a carton or box for shipping. Pouch dimensions are typically designed so as to be somewhat confining, yet allow enough room to facilitate product insertion and removal. Thus, once placed in the pouch, the article is still somewhat free to slide around. The article is immobilized for shipment by the squeezing effect created by folding over the top inflated portion 14 which applies compressive force and friction to the article.

The invention advantageously applies to the transporting and to the handling of any fragile merchandise, and especially electronic, computer or other equipment, with the ability to use a single inflatable cushion to protect all the sides of the product and to be able to reuse it several times.

The invention has been described in detail with particular reference to a preferred embodiment and the operation thereof, but it is understood that variations, modifications, and the substitution of equivalent means can be effected within the spirit and scope of the invention.

What is claimed is:

1. An inflatable packaging cushion of flexible material adapted to be at least partially charged with filler medium comprising:

a containment portion;

an article-holding portion;

a hinged portion interconnected to said article-holding portion and said containment portion;

a pocket formed integrally with said article-holding portion for holding an article;

at least one internal opening in said hinged portion to facilitate said containment portion being folded over said article-holding portion; and filling means for at least partially charging said cushion with filler medium.

2. The inflatable packaging cushion according to claim 1 wherein said cushion comprises a pair of juxtaposed thermoplastic sheets having the outer peripheral edges thereof sealed together to form said cushion.

3. The inflatable packaging cushion according to claim 1 wherein said filling means is a single self-sealing inflation valve.

4. The inflatable packaging cushion according to claim 1 wherein said hinged portion has a plurality of internal openings.

5. The inflatable packaging cushion according to claim 1 wherein said containment portion overlays at least a majority of said article-holding portion and having at least one internal opening therein defined by a seam.

6. The inflatable packaging cushion according to claim 1 wherein said article-holding portion has at least one internal opening therein defined by a seam.

7. The inflatable packaging cushion according to claim 1 wherein said filler medium is air.

8. An inflatable packaging cushion of flexible thermoplastic material adapted to be at least partially charged with air comprising:

a containment portion;

an article-holding portion;

a hinged portion interconnected to said containment portion and said article-holding portion;

a pocket formed integrally with said article-holding portion for holding an article;

a plurality of internal openings in said hinged portion to facilitate said containment portion being folded over said article-holding portion; and a single self-sealing inflation valve for at least partially charging said cushion with air.

9. The inflatable packaging cushion according to claim 8 wherein said containment portion overlays at least a majority of said article-holding portion and having an internal opening therein defined by a seam.

10. The inflatable packaging cushion according to claim 8 wherein said article-holding portion has at least one internal opening therein defined by a seam.

* * * * *